US005697507A

United States Patent [19]

Blass

[11] Patent Number: 5,697,507

[45] Date of Patent: Dec. 16, 1997

[54] SHELVING/DISPLAY MERCHANDISING SYSTEM FOR STORES

[76] Inventor: Clive Jeremy Blass, 23 Daws Lane, London, NW7 4SD, England

[21] Appl. No.: 650,392

[22] Filed: May 20, 1996

[51] Int. Cl.[6] ..... A47F 5/00

[52] U.S. Cl. ..... 211/94; 211/103; 211/90

[58] Field of Search ..... 211/94, 94.5, 87, 211/103, 90, 208, 193, 189

[56] References Cited

U.S. PATENT DOCUMENTS

| | | | |
|---|---|---|---|
| 3,425,568 | 2/1969 | Albright | 211/94 X |
| 3,685,234 | 8/1972 | Nelsson | 52/36.6 |
| 5,110,080 | 5/1992 | Rieman | 211/94 X |
| 5,305,898 | 4/1994 | Merl | 211/103 X |
| 5,472,103 | 12/1995 | Merl | 211/94 X |
| 5,509,541 | 4/1996 | Merl | 211/94 X |

FOREIGN PATENT DOCUMENTS

| | | | |
|---|---|---|---|
| 13516 | 7/1980 | European Pat. Off. | 52/36.6 |

*Primary Examiner*—Robert W. Gibson, Jr.
*Attorney, Agent, or Firm*—Marks & Clerk

[57] ABSTRACT

A shelving/display and merchandising system for stores includes, a pair of elongate channel-section runner elements intended to be mounted in a vertically spaced horizontal arrangement. Vertical post members are fitted to the runner elements and provide support for brackets. Each runner-element has its upper and lower side flanges formed with a row of slots and the post members have tongues to co-act with these slots. One tongue is shorter than the other to enable mounting and dismounting of the post members on the runner elements with the latter fixed in place.

9 Claims, 4 Drawing Sheets

SHELVING/DISPLAY MERCHANDISING SYSTEM FOR STORES

This invention relates to a shelving/display and merchandising system for stores and for other uses.

A system in accordance with the invention comprises at least a pair of elongate runner elements which are arranged, in use, to extend generally horizontally one above the other, each runner element having at regular intervals along its length slots or other formations, at least one post member having a tongue or other formation at each end for releasable engagement with a slot or other formation in one of the runner elements, the post members extending, in use, between the two runner elements and being releasably engaged therewith, and at least one bracket element for releasable attachment to the post element.

The system defined above makes it possible to arrange display units on a wall or other support in many different configurations and is more flexible than known systems which employ a top rail and posts hung on the top rail and either engaging the floor or provided with a foot for engaging the wall or other support. Furthermore, the post members are attached to the runner elements top and bottom, thereby preventing swinging on other disturbance of the posts or loads carried thereby.

Figure 2:
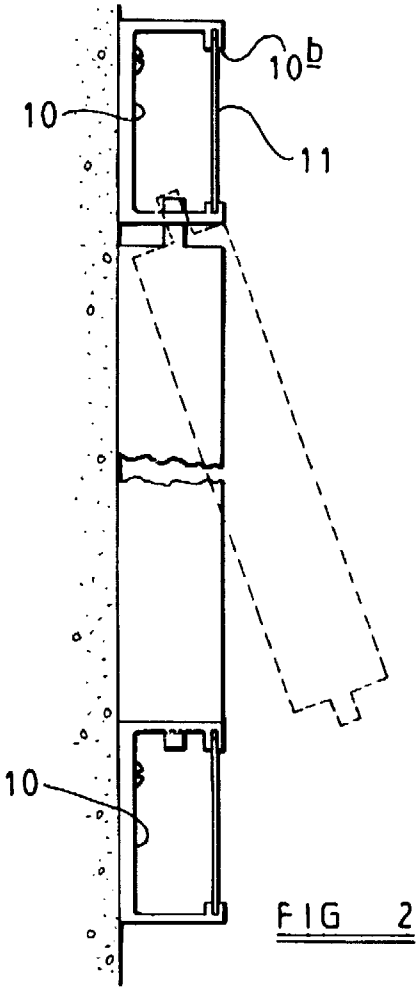
FIG. 2 is an end view of the same assembly.
Figure 1:
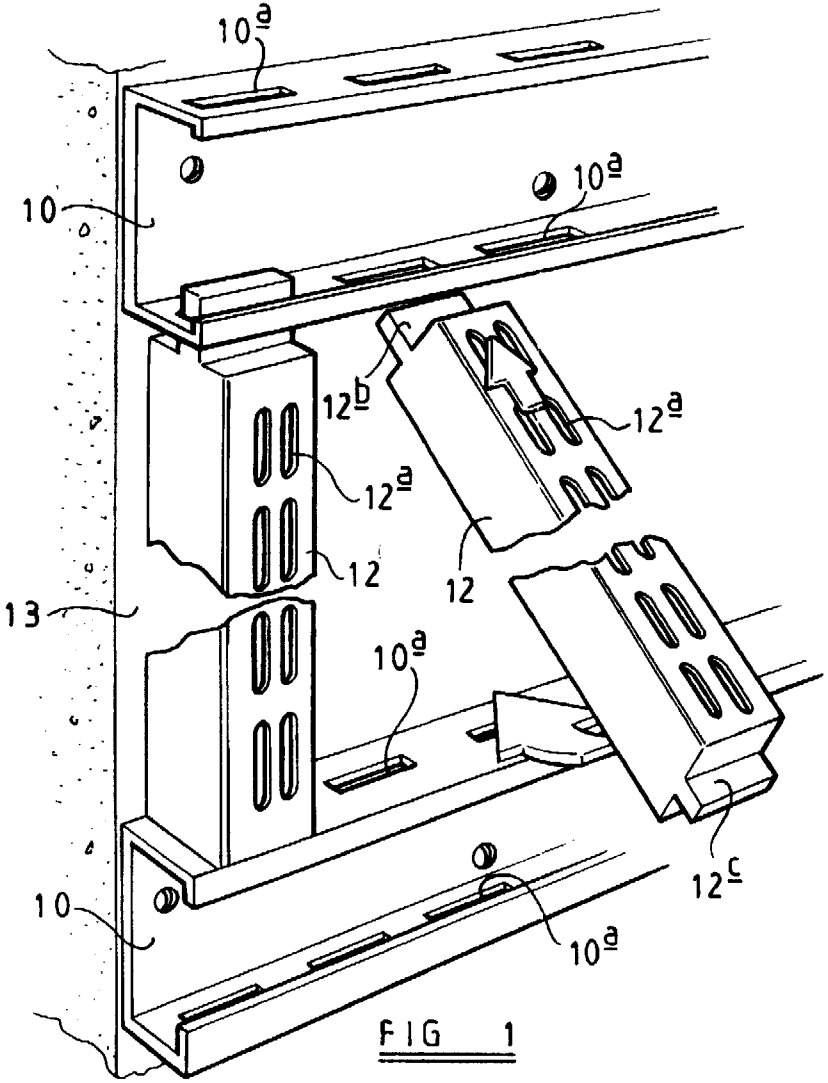
FIG. 1 is a perspective view of a runner/post assembly of an example system in accordance with the invention.

Referring firstly to FIGS. 1 and 2, the system shown utilises horizontally extending runner elements 10, which are of channel shaped configuration. The two side flanges of each runner element has a row of slots therein spaced at regular intervals along the length of the runner element. At its mouth, the channel 10 may have one or more in-turned fins 10*b* to hold a cover plate (FIG. 2).

The system also includes posts 12, which are also of channel-shaped material. In this case the base web of the channel is formed with two rows of slots arranged at regularly spaced intervals along the posts. At each end, each post is provided with a tongue element 12*b*, 12*c* one of these being longer than the other. The tongues are shaped and dimensioned to be received by the slots 10*a*.

As will be seen from FIGS. 1 and 2 the posts can be assembled with the runners after the latter have been fixed to the wall or other support 13 at the appropriate vertical spacing, by inserting the longer tongue 12*b* on each post into a slot in the lower flange of the upper runner element, swinging the post in above the lower runner element and lowering the post so that a slot in the upper flange of the lower runner element receives the shorter tongue 12*c*. The post is now captive and can be removed only by following the reverse sequence of operations.

The lengths of the body of the post 12, and its two tongues are such that the sum of the lengths of the body and the shorter tongue is less than the spacing between the runner elements, whilst the sum of the lengths of the body and the longer tongue exceeds such spacing.

Whilst slotted flanged channels have been employed as runner elements and posts with projecting tongues have been employed in the above described embodiment, it will be understood that other formations could be used. For example the slots could be replaced by round holes and each post could have two projecting dowels on each end.

Various brackets which can be used with the system are shown in FIGS. 6 to 10 and, in each these have hooked tongues to fit the slots 12*a* in the posts.

Figure 3:
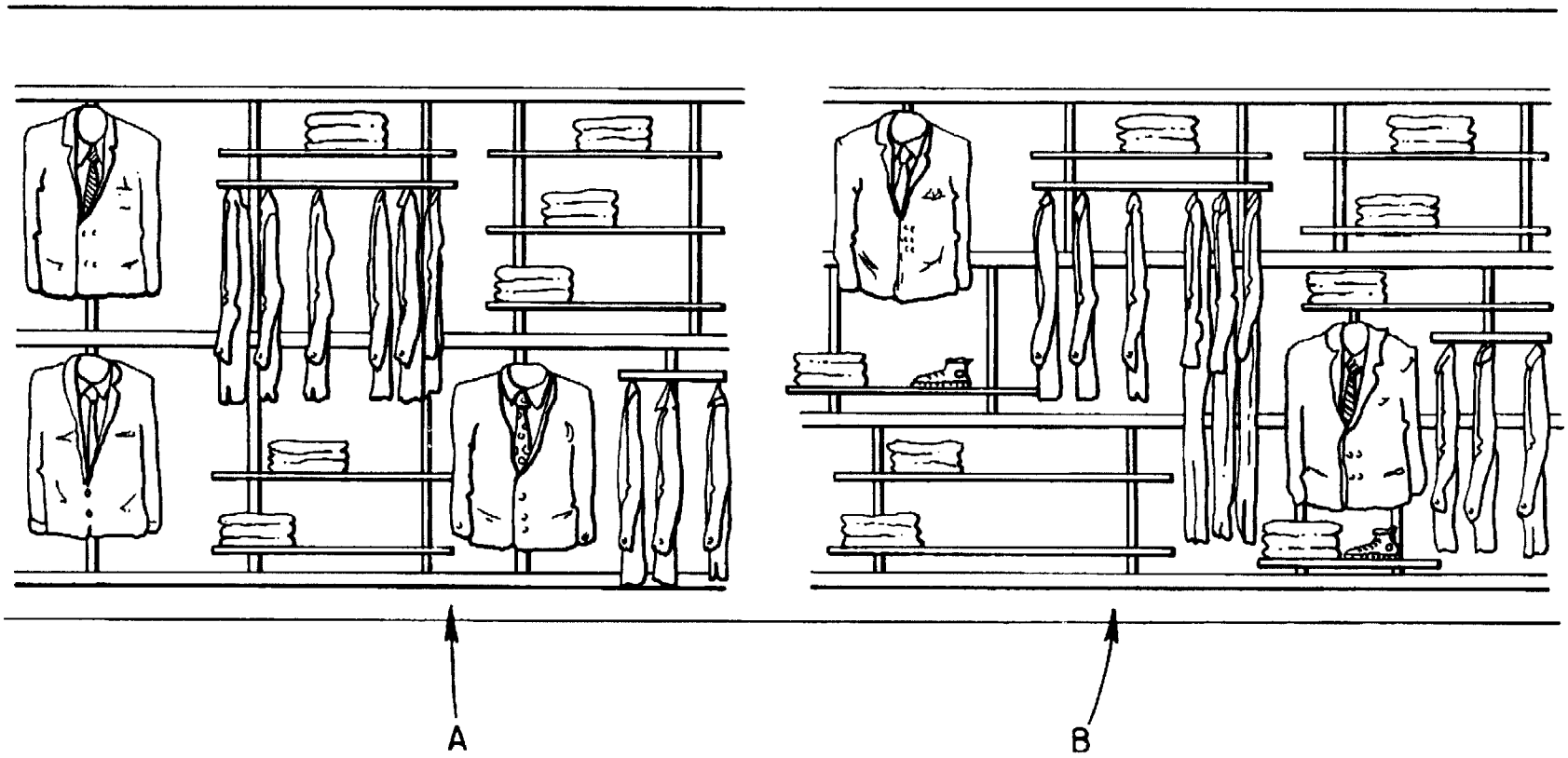
FIG. 3 is an elevation of a complex display arrangement made up using the system.
Figure 5:
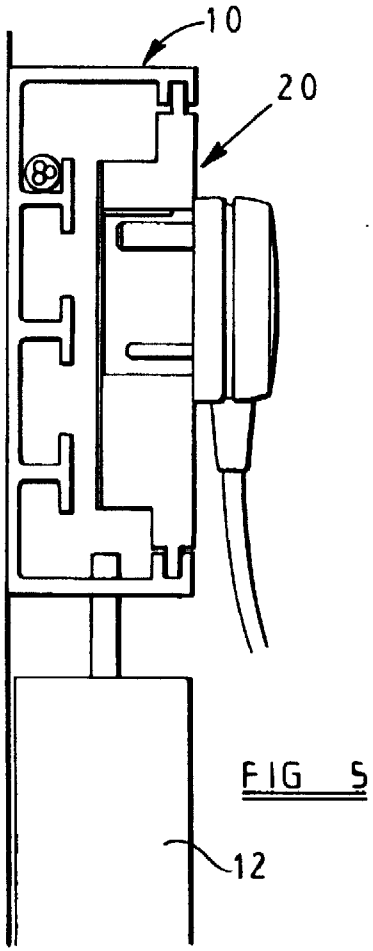
FIG. 5 is a detail section of the upper runner element used in FIG. 4.

FIG. 3 shows a complex array of different shelves and brackets in a display including a three runner section A and a four runner section B. Such a configuration can easily be specified by a display designer who can note which slots are to be used.

Figure 4:
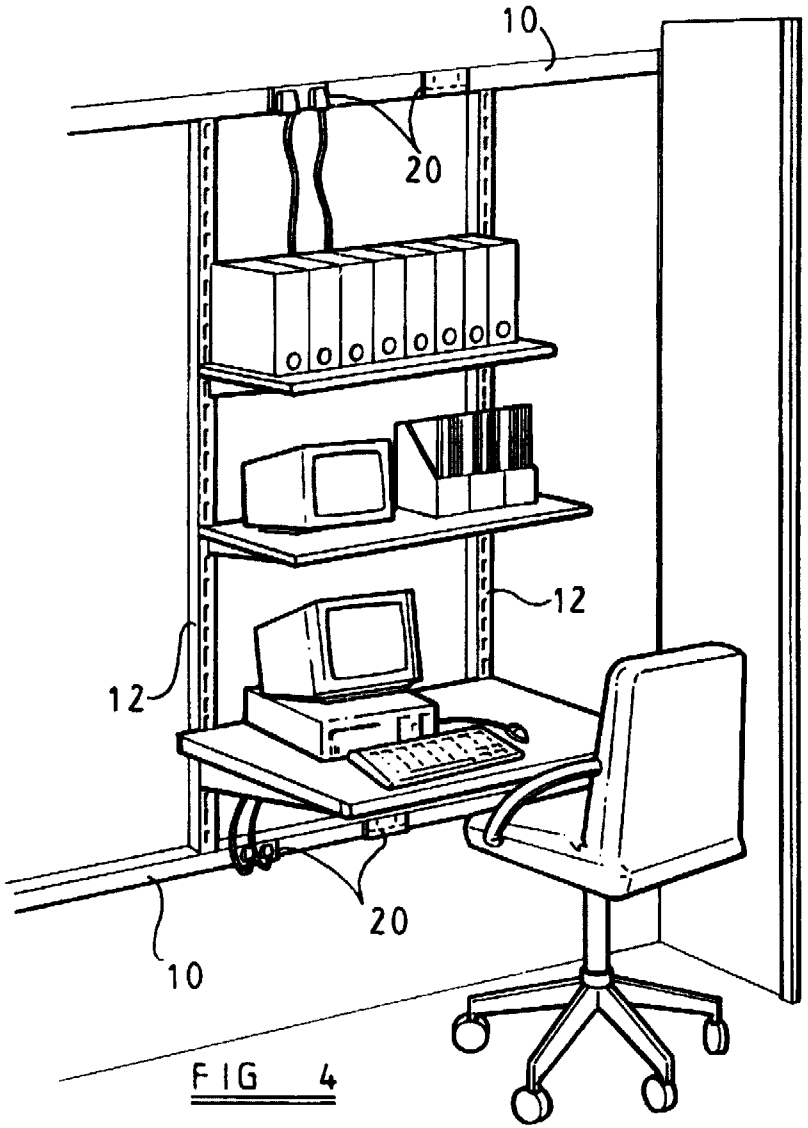
FIG. 4 is a perspective view of the same system used to create an office workstation arrangement.
Figure 6:
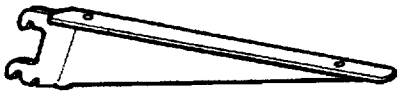
FIGS. 6 to 10 are perspective views of various different brackets which can be used in the example of the system thus far described.
Figure 7:
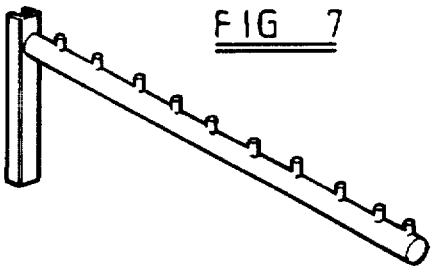
Figure 8:
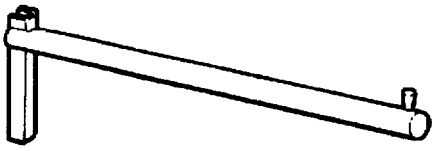
Figure 9:
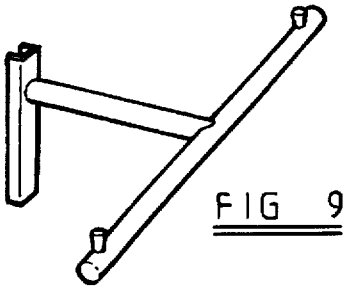
Figure 10:
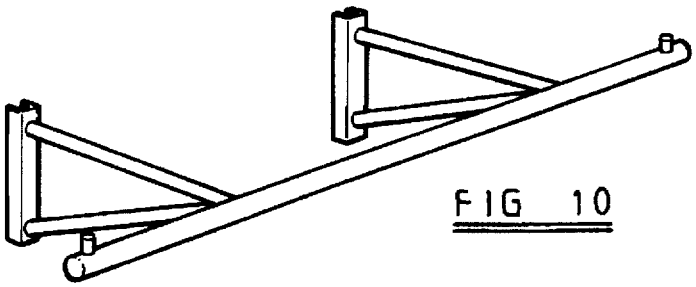

FIG. 4 shows a simple application of the system, namely a simple wall-hung computer workstation. Here, the upper and lower runner elements conceal wiring and appropriate sockets 20 for connection to this wiring a located in the front plate of the runner elements.

Figure 11:
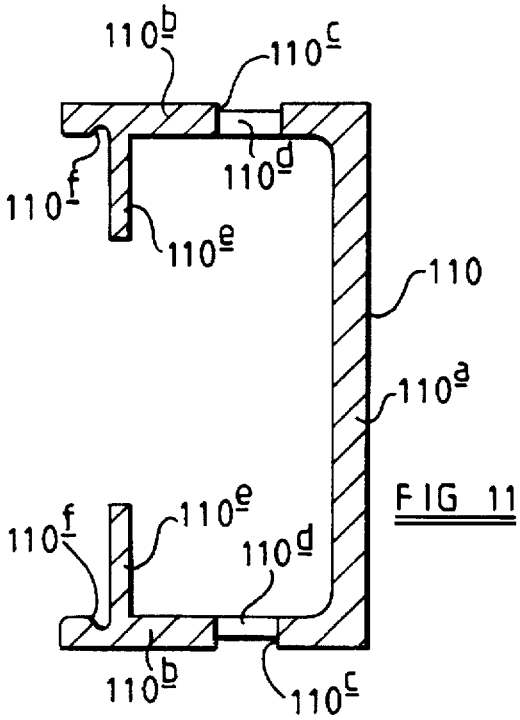
FIG. 11 is a section showing a runner element for a second embodiment of the invention.
Figure 12:
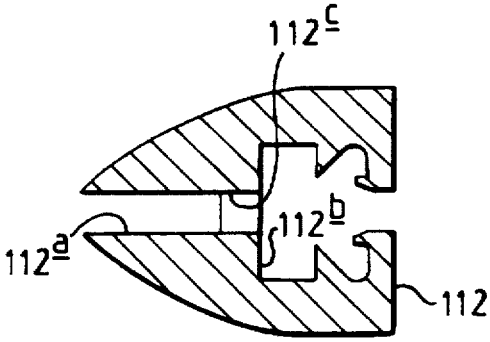
FIG. 12 is a section showing the post member used with the runner element shown in FIG. 11.

FIGS. 11 and 12 are cross-sections showing the runner element 110 and the post member 112 of another embodiment of the invention. In this case the runner element is again basically of channel shaped configuration having a base web 110*a* and spaced side flanges 110*b*. Each side flange 110*b* is formed with an external groove 110*c* and there are slots 110*d* cut through from the base of each groove 110*c* to the interior of the channel at regularly spaced positions along the length of the runner element. A pair of front fins 110*e* extend from the two side flanges 110*b* across the mouth of the channel and each side flange has an undercut 110*f* adjacent the fin to receive a front trim plate.

The post member 112 is of substantially semi-elliptical cross-section with a deep groove 112*a* running along its length. There is an internal chamber 112*b* within the post which is shaped to receive at its ends push-fit elements to provide fitting tongues similar to those included in the example shown in FIGS. 1 and 2. There is a row of uniformly spaced slots 112*c* in a web which separates the deep groove in the post member from the internal chamber. The brackets (not shown) which are used with the post 112 have a flat tongue to be received in the groove 112*a* and hooks on this tongue to engage in the slots 112*c*.

The sections shown in FIGS. 11 and 12 are used in exactly the same way as those shown in FIGS. 1 and 2. The location of the slots 110*d* in grooves in the runner elements 110 tends to make it more difficult for the casual observer to notice that the runner elements are, in fact, slotted, since the grooves create shadows which conceal the slots. Similarly the slot 112*c* in the post members are well concealed by being located at the base of a deep groove. Hence, the system gives the impression of one which has continuous un-slotted components.

I claim:

1. A shelving/display and merchandising system comprising:

at least a pair of elongate runner elements which are extended generally horizontally one above the other forming an upper running element and a lower running element, each runner element having an upper side, an underside and a plurality of openings at regular intervals along the length of said runner, at least one post member having a top end, a bottom end and a projection at each said top and bottom end for releasable engagement with one of the openings in one of the runner elements, the post member extending between the two runner elements and being releasably engaged therewith, and at least one bracket element for releasable attachment to the post member, wherein the projection on the top end of the post member is engaged in one of said openings in the underside of the upper runner elements and the projection at the lower end of the post member is engaged in one of said openings in the upper side of the lower runner element.

2. A system as claimed in claim 1, in which each runner element is in the form of an elongate channel having a base web and a pair of spaced side flanges, said plurality of openings being formed in said side flanges.

3. A system as claimed in claim 2, in which said post member comprises an elongated body portion and a projection at each end of the body portion projecting longitudinally of the body portion.

4. A system as claimed in claim 3, in which the projection at opposite ends of the body portion are of different lengths measured in the longitudinal direction of the post member.

5. A system as claimed in claim 4, in which the sum of the lengths of the body portion and the shorter of said tongues is less than the spacing between the runner elements and the sum of the lengths of the body portion and the longer of said projection is greater than such spacing.

6. A system as claimed in claim 2, in which each side flange of each runner element is formed with a longitudinally extending groove, the plurality of openings being formed within the confines of said groove.

7. A system as claimed in claim 2, in which each runner element has a pair of front fins extending towards one another from opposite side flanges.

8. A system as claimed in claim 7, in which each side flange is formed with an undercut to receive and retain a co-acting front plate.

9. A system as claimed in claim 1, in which each post member is of substantially semi-elliptical cross-section and having with a groove running longitudinally of the post member for receiving a tongue on said bracket and having a plurality of openings within such groove to co-act with the bracket.

* * * * *